US005529307A

United States Patent [19]

Chang

[11] Patent Number: 5,529,307

[45] Date of Patent: Jun. 25, 1996

[54] AUTOMATIC GOLF BALL DISPENSER

[76] Inventor: Kevin J. Chang, 600 Boxcove Pl., Diamond Bar, Calif. 91765

[21] Appl. No.: 376,912

[22] Filed: Jan. 23, 1995

[51] Int. Cl.[6] ..... A63B 57/00

[52] U.S. Cl. ..... 473/136; 473/137

[58] Field of Search ..... 273/201, 33

[56] References Cited

U.S. PATENT DOCUMENTS

| | | | |
|---|---|---|---|
| 2,675,237 | 4/1954 | Willcox | 273/201 |
| 3,602,506 | 8/1971 | Gentiluomo | 273/201 |
| 3,756,606 | 9/1973 | Land | 273/201 |
| 3,778,067 | 12/1973 | Gentiluomo | 273/201 |
| 4,360,204 | 11/1982 | Karr | 273/201 |
| 4,817,955 | 4/1989 | Hickson et al. | 273/201 |
| 4,995,614 | 2/1991 | Tange | 273/201 |

*Primary Examiner*—Steven B. Wong
*Attorney, Agent, or Firm*—David C. Ashby

[57] ABSTRACT

An automatic golf ball dispenser includes a housing having a substantially horizontal top and a plurality of substantially vertical sides. Within the housing is a storage bin and track configured to receive a plurality of golf balls and to deliver the golf balls to a feed mechanism. The feed mechanism includes a meter configured to dispense a single golf ball for each movement of the meter. An arm mounted on a pivot retrieves the single golf ball from the feed mechanism and places the golf ball at a predetermined location for a golfer to hit the golf ball. A sensor is located nearby to indicate when another golf ball should be dispensed. A controller is also contained within the housing and configured to accept currency, where the controller is electrically connected to the sensor and responsive to the sensor, and where the controller is also electrically connected to an arm motor to control the movement of the arm. In another aspect of the invention, a solar panel is added as a backup power source, and as a way to recharge an internal battery. In another aspect of the invention, a network of pipes distributes golf balls to a plurality of golf ball dispensers.

20 Claims, 5 Drawing Sheets

AUTOMATIC GOLF BALL DISPENSER

FIELD

The present invention relates to an automatic golf ball dispenser. Moreover, the present invention relates to an apparatus that automatically dispenses golf balls to various stations at a golf ball driving range.

BACKGROUND

Golf is a popular sport that requires practice. One way to acquire practice is to visit a driving range to practice hitting golf balls. However, once at the driving range, a person must continually bend over to pick up a ball to place it on a tee. This requires a break in the continuity of practice, and it prevents the person from improving his golf swing while maintaining an upright stance. Moreover, beding down to place the ball onto the tee can cause discomfort to people with back problems.

Another problem with present driving ranges is that the person must obtain a token from a pro shop, walk over to a central golf ball dispenser to obtain an allotment of golf balls and then carry the golf balls in a bucket over to a hitting station where he manually positions each ball on the tee. Besides being inconvenient, this procedure further disrupts practice since the person must revisit the central dispenser each time the person wishes to obtain additional golf balls.

An additional concern among driving range operators is the degree of human involvement needed to operate the range. Present driving range operation is labor intensive. For example, a person is needed to dispense tokens, to collect golf balls and to deliver the golf balls to the central golf ball dispenser.

What is needed is an apparatus that automatically places a golf ball on a tee or a green mat. This type of apparatus would have the benefit to permit the user to maintain an upright position during practice so that the person's muscle memory can develop an improved swing without continually bending over to position a ball on the tee. Also, this type of apparatus would have the further benefit to position the ball on the tee at the hitting station, rather than requiring the person to walk to a central dispenser to receive an allotment of golf balls. Additionally, automation would reduce the reliance on labor and allow expanded operating hours.

SUMMARY

The present invention is directed at an automatic golf ball dispenser for use at a driving range. The invention provides a mechanism so that a person can maintain an upright stance to improve his golf swing. This promotes muscle memory and leads to improved golf skills. It also permits those persons with back problems to enjoy golf. Moreover, the invention provides golf ball dispensing at the hitting station to provide convenience to the user. Additionally, the invention reduces the reliance on labor and expands the driving range operating hours.

An automatic golf ball dispenser includes a housing having a substantially horizontal top and a plurality of substantially vertical sides. Within the housing is a storage bin and track configured to receive a plurality of golf balls and to deliver the golf balls to a feed mechanism. The feed mechanism includes a meter configured to dispense a single golf ball for each movement of the meter. An arm mounted on a pivot retrieves the single golf ball from the feed mechanism and places the golf ball at a predetermined location for a golfer to hit the golf ball. A sensor is located nearby to indicate when another golf ball should be dispensed. A controller is also contained within the housing and configured to accept currency, where the controller is electrically connected to the sensor and responsive to the sensor, and where the controller is also electrically connected to an arm motor to control the movement of the arm.

In another aspect of the invention, a solar panel is added as a backup power source, and as a way to recharge an internal battery. In another aspect of the invention, a network of pipes distributes golf balls to a plurality of golf ball dispensers.

DETAILED DESCRIPTION

The embodiments described are directed at an automatic golf ball dispenser. Those skilled in the art will appreciate that various changes and modifications can be made to the embodiments while remaining within the scope of the present invention.

Figure 1:
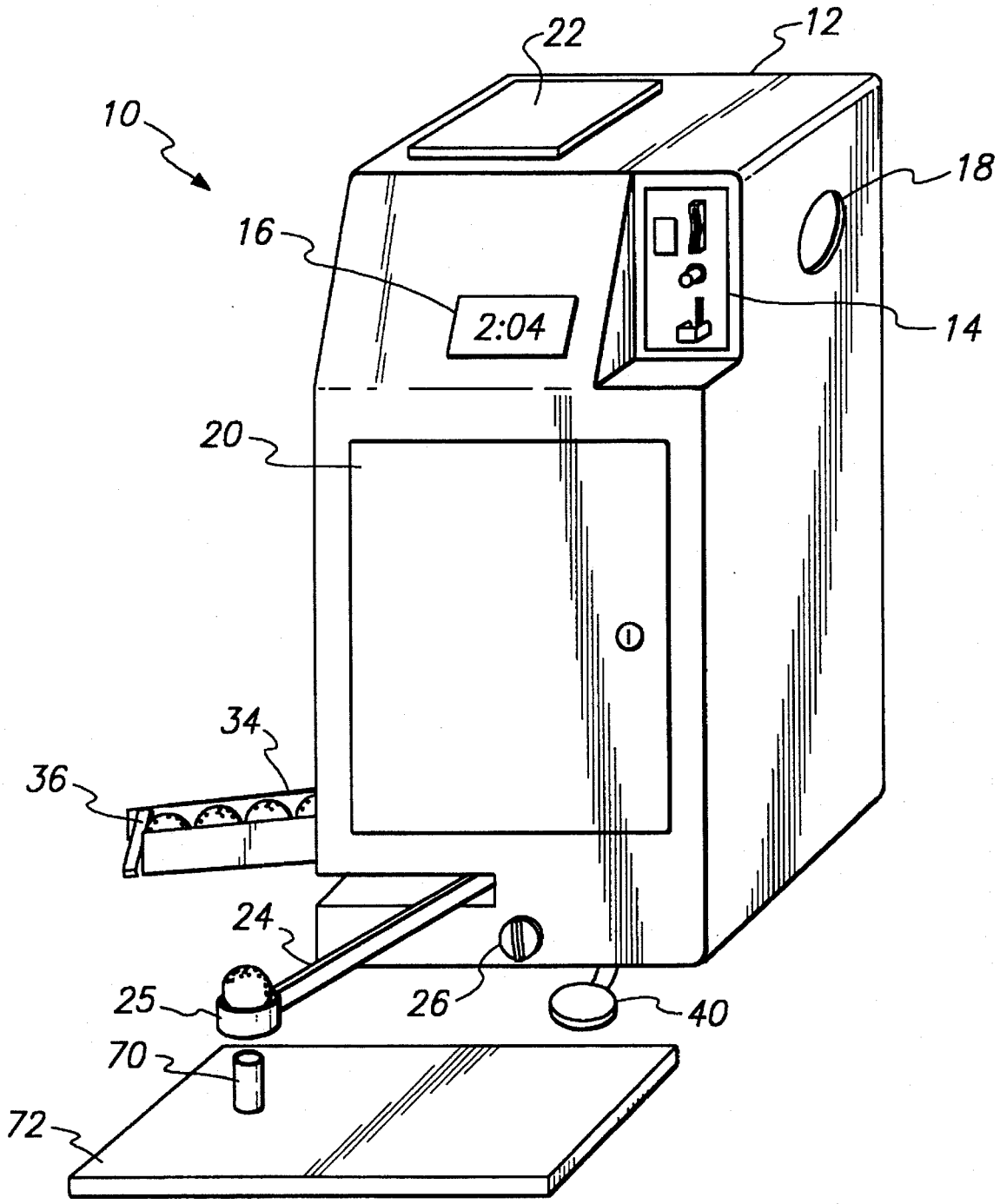
FIG. 1 depicts a first embodiment of the invention with the arm extended to place a golf ball on a tee.

A first embodiment is explained with reference to FIGS. 1 and 2. An automatic golf ball dispenser 10 includes a housing 12 having a substantially horizontal top and a plurality of substantially vertical sides. A sealer, such as a silicon rubber gasket, is placed around the base of the dispenser to prevent water from entering the housing 12. This sealed housing resists water from contacting the internal electronics including a controller, as discussed below.

A currency unit 14 is disposed on the front of the housing 12 at a convenient location for the user to access, such as on the front as shown. A display 16 is also provided for the user to indicate important information to the user, such as the amount of operating time remaining for the currency deposited, the number of balls remaining for the currency deposited, the time of day, an error condition for diagnostics, the amount of usage the machine has had, or other similar information.

In the first embodiment, an opening 18 is provided in the housing 12 to permit the delivery of golf balls to the dispenser 10. An alternative for filling the machine with balls, also shown in FIG. 1 is a lid 22 to fill the golf ball dispenser with golf balls. In either case, the golf balls are delivered to a storage bin 30, which is large enough to hold sufficient golf balls to supply the user with golf balls during his practice session, for example 100 balls or greater.

Figure 2:
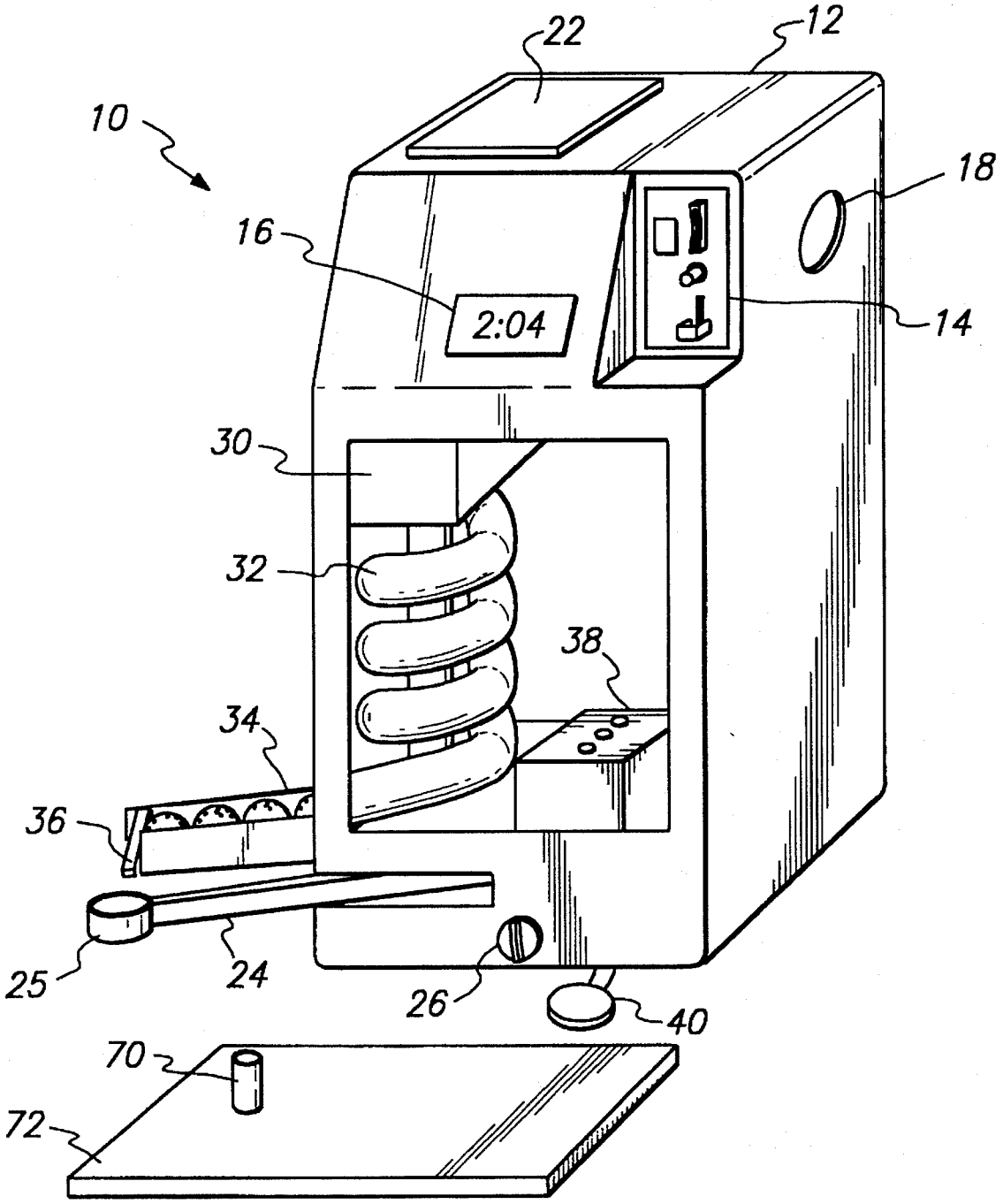
FIG. 2 shows the interior of the first embodiment with the service door open.

FIG. 2 shows the dispenser with service door 20 removed. Within the housing 12 is the storage bin 30 and a track 32 configured to receive a plurality of golf balls and to deliver the golf balls to a feed mechanism 34. The storage bin 30 is located above the track 32 and stores sufficient golf balls for a period of time such that a user can complete his practice without running out of balls. Preferably, the bin 30 contains enough balls for several hours of use. An agitator is disposed within the bin to stimulate some movement of the balls to prevent the balls from clogging in the bin 30 during operation. A preferred agitator uses a hinged plate located near the bottom of the bin that slowly oscillates back and forth during operation. An alternate agitator uses an arm located near the bottom of the bin that slowly spins during operation.

The bin 30 delivers the balls to the track 32, which spirals from the bin downward to the feed mechanism 34. Gravity feed works well to encourage the balls along in the track, and to deliver the balls to the feed mechanism.

Figure 3:
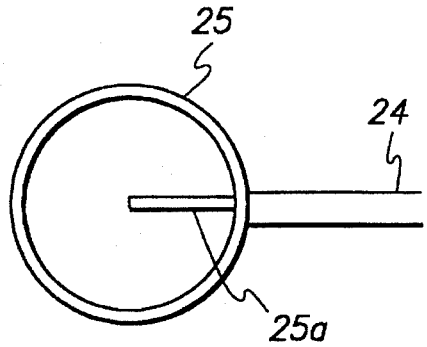
FIG. 3 shows the receiver for the arm of the first embodiment.
Figure 4:
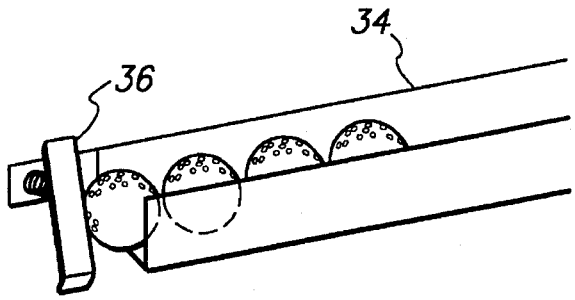
FIG. 4 shows the track and meter of the first embodiment.

The feed mechanism 34 includes a meter 36 which is configured to dispense a single golf ball for each movement of the meter. An arm 24 is independently mounted on a pivot. An arm motor 27 is disposed within the housing 12 to drive the arm pivot motion. The arm 24 has a receiver 25, similar to a small cup, near the end of the arm for receiving a golf ball, as shown in FIG. 3. When the receiver 25 contacts the meter 36, only one ball is delivered to the receiver 25 from the meter 36. The meter works by having a release and a stop, as shown in FIG. 4. The release is activated by the receiver 25 coming into contact with the release, and the stop is spring loaded to stop the next ball in line from advancing. When a ball is released from the meter 36, the next ball is stopped in position at the meter 36.

When the receiver 25 initially accepts the golf ball, a pin 25*a* is in an extended position in the lower portion of the receiver 25 to support the ball in the receiver. The receiver holds the golf ball and carries it as the arm moves to place the golf ball at a predetermined location for a golfer to hit the golf ball. Once the arm reaches the predetermined position, the arm movement stops, the pin 25*a* is retracted and the ball is allowed to fall through the receiver 25. In this manner, the ball is placed at the predetermined position.

The predetermined position is set by a selector 26, which determines how far the arm 25 is permitted to pivot. This is done by a mechanical stop. For example, the user can set the arm to pivot a small amount and place the ball on the tee 70, or can set the arm to pivot a large amount and place the ball on the mat surface 72. When the arm reaches the point determined by the selector 26 as the delivery point, the pin 25*a* is retracted and the ball is placed at that position for the user to hit. Often this position will be on a tee 70 disposed through mat 72, and sometimes the position will be on the mat surface 72 rather than on the tee, depending on the user's setting of the selector 26.

A sensor 40 is located nearby to indicate that another ball should be dispensed. For example, a sensor pad 40 is shown in FIG. 1 for the user to press with a golf club or his foot. Another type of sensor that could be used is a photodetector sensor that senses when the ball has been hit from the tee. This type of sensor transmits a beam of light at the golf ball and senses a reflection. When the reflection is detected, the golf ball is on the tee. When the reflection is not detected, the golf ball has been hit and the dispenser places another ball on the tee. In any case, the purpose of the sensor is to send a signal to a controller 50 to indicate that another ball should be dispensed.

The controller 50 is also contained within the housing and configured to accept currency. In the present invention, the term currency is broadly defined to include both common currency such as dollar bills or tokens, and electronic currency such as that stored on a card with a magnetic strip or semiconductor chip. In this context, the controller has a means for accepting currency because the controller receives a signal from the currency unit 14 indicating the amount of money paid, and can determine the length of time that a user can use the golf ball dispenser or the number of balls that the user is entitled to receive based on that amount of money. The present invention is useful at a range where the user pays money to a central collection machine which gives the user a card with a specified credit. Then the user can use the credit with the machine using the card. Further, along these lines, the controller has the ability to control the number of balls hit for a given payment, the amount of time the dispenser is active for a given payment, or a combination of ball number and activation time.

Figure 5:
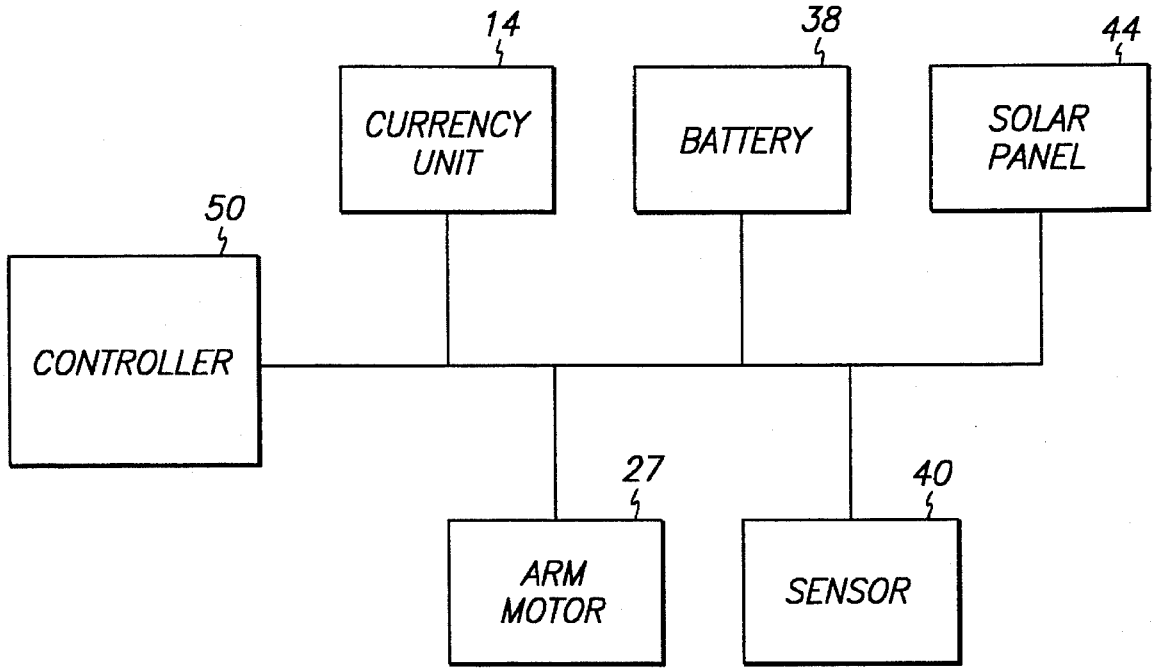
FIG. 5 illustrates the electrical connections in the first embodiment of the invention.

The controller 50 and electrical assembly is shown in FIG. 5. The controller uses a standard microprocessor device that is specially programmed to execute the required control instructions. For example, a Z80 microprocessor from Zilog can be used as well as a 6800 microprocessor from Motorola. Both of these types of microprocessors use standard programming languages that are available from the manufacturers and known in the art.

The controller 50 is electrically connected to a power source such as a battery 38, or other voltage source such as 110VAC. The controller 50 is electrically connected to the arm motor 27 which controls both the pivot of the arm 24 and the movement of the receiver pin 25*a* located within receiver 25 at the end of the arm 24.

The controller is also connected to the sensor 40 which indicates that another ball should be dispensed. When the sensor indicates, the controller is responsive to the sensor and initiates the dispenser to dispense another ball. This includes activating the arm motor 27 to retrieve another golf ball from the meter 36 and deliver it to the tee for the user to hit.

Figure 6:
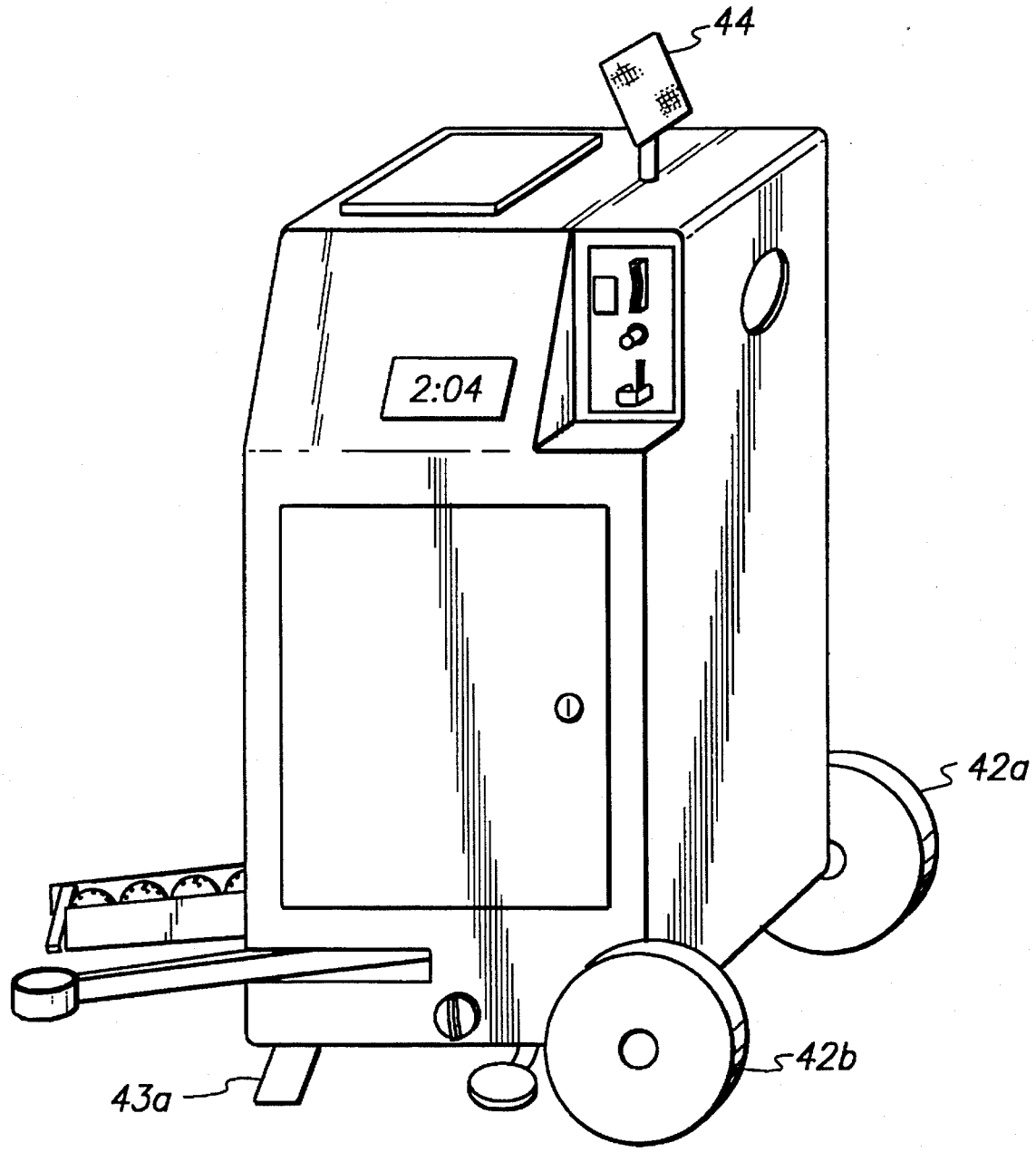
FIG. 6 depicts a second embodiment of the invention having a portable feature.

A second embodiment is depicted in FIG. 6, where a set of wheels 42*a*, 42*b* are attached to the housing 12 to create a portable golf ball dispenser. A set of legs are also provided near the other corners of the dispenser to keep the unit level where it is deployed. This embodiment is provided with a battery 38 to power the dispenser 10, and a solar panel 44 to recharge the battery. The solar panel is preferably mounted on a pivoting post to permit the panel to be positioned toward the sun. In this embodiment, the controller 50 is further electrically connected to the solar panel 44 as a power source to the controller and a means to recharge the battery 38. One advantage of this embodiment is that it can be easily moved for any purpose such as cleaning, the onset of bad weather or flooding. Another advantage of this embodiment is that it can be deployed at a golf course where there is no 110VAC power available at the driving range, such as at a grass golf range.

Figure 7:
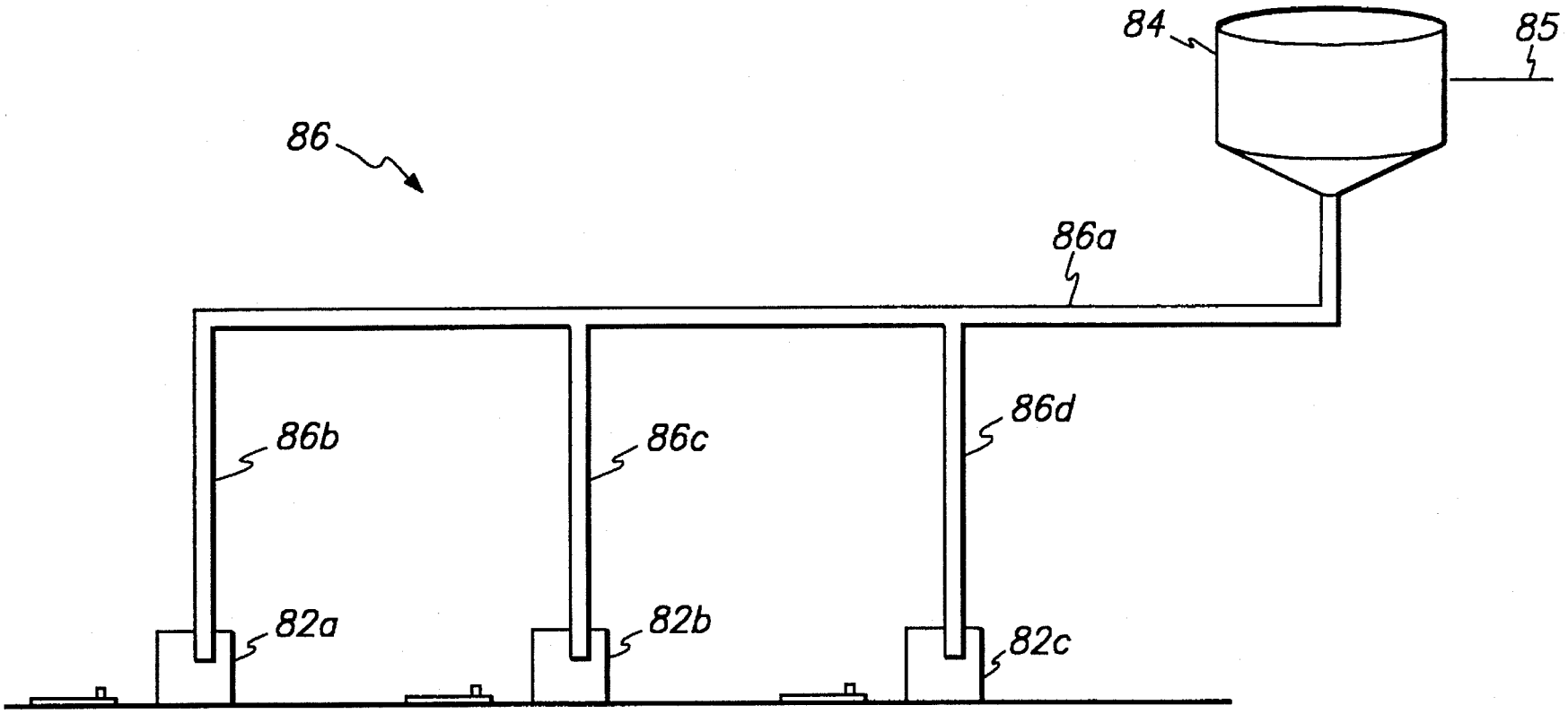
FIG. 7 depicts a third embodiment of the invention showing a golf ball distribution network for a plurality of golf ball dispensers.

A third embodiment is described with reference to FIG. 7. This embodiment is directed at a distribution network for golf balls from a main storage bin 84 to a plurality of golf ball dispensers 82*a*, 82*b*, 82*c*.

When the golf balls are collected, they are placed into a main storage bin 84. This bin is large enough to hold enough golf balls for a typical day at the driving range, for example, 1,000 to 10,000 balls or more. In one aspect of the invention, an operator walks to platform 85 and manually fills the main storage bin 84. In another aspect of the invention, the balls are automatically fed into the main storage bin 84 by a feed mechanism such as one that washes the golf balls and then delivers them to the main storage bin.

As shown, the main storage bin 84 is elevated above the position of the golf ball dispensers 82*a*, 82*b*, 82*c*. This position is beneficial to provide gravity feed of the golf balls to the golf ball dispensers. Alternatively, another type of feed mechanism could be used such as a pneumatic feed or mechanical feed, as are known in the art.

The main storage bin 84 is connected to a distribution network 86 that is constructed from pipe material such as PVC pipe. The distribution network 86 is made from a main pipe 86*a* that feeds a number of individual pipes 86*b*, 86*c*, 86*d*, which in turn feed the golf balls to individual golf ball dispensers 82*a*, 82*b*, 82*c*. The individual pipes 86*b*, 86*c*, 86*d* are connected to each of the dispensers through the dispenser opening 18, as shown in FIG. 1. This connection allows the individual pipes to deliver golf balls to each of the golf ball dispenser's storage bins.

Having disclosed a preferred embodiment and the best mode, modifications and variations may be made to the disclosed embodiments while remaining within the subject and spirit of the invention as defined by the following claims.

What is claimed is:

1. An automatic golf ball dispenser comprising:

a storage bin configured to store a plurality of golf balls;

a meter connected to the storage bin and configured to selectively dispense a single golf ball;

an arm independently mounted on a pivot to retrieve the single golf ball from the meter and to place the bail at a predetermined location for a user to hit the golf bail;

a sensor to indicate that another bail should be dispensed from the meter; and a controller electrically connected to the sensor and responsive to the sensor, the controller also electrically connected to an arm motor to control movement of the arm.

2. The dispenser of claim 1, further comprising:

a track coupled to the storage bin and configured to receive the golf bails from the storage bin and to deliver the golf balls to the meter.

3. The dispenser of claim 1, wherein:

said controller is disposed within a sealed housing that resists water from contacting the controller.

4. The dispenser of claim 1, where:

the storage bin is adapted to accept a distribution network that delivers golf balls.

5. The dispenser of claim 1, wherein:

the controller is configured to accept currency; and the controller further controls the amount of time that the dispenser operates based on a predetermined currency payment.

6. The dispenser of claim 1, wherein:

the controller is configured to accept currency; and the controller controls the number of balls that the dispenser dispenses based on a predetermined currency payment.

7. The dispenser of claim 1, further comprising:

a battery to power said controller; and a solar panel to recharge said battery.

8. The dispenser of claim 1, further comprising:

a plurality of wheels attached to said dispenser to permit a person to portably locate the dispenser.

9. A portable automatic golf ball dispenser comprising:

a storage bin configured to store a plurality of golf balls;

a meter connected to the storage bin and configured to selectively dispense a single golf ball;

an arm independently mounted on a pivot to retrieve the single golf ball from the meter and to place the ball at a predetermined location for a user to hit the golf ball;

a sensor to indicate that another ball should be dispensed from the meter;

a controller electrically connected to said sensor and responsive to the sensor, the controller also electrically connected to an arm motor to control movement of the arm; and a plurality of wheels attached to said dispenser to permit a person to portably locate the dispenser.

10. The portable dispenser of claim 9, further comprising:

a solar panel electrically connected to said controller.

11. An apparatus for delivering golf balls to a plurality of golf ball driving stations comprising:

(a) a plurality of automatic golf ball dispensers each including:

a storage bin configured to store a plurality of golf balls;

a meter connected to the storage bin and configured to selectively dispense a single golf ball;

an arm independently mounted on a pivot to retrieve the single golf ball from the meter and to place the ball at a predetermined location for a user to hit the golf ball;

a sensor to indicate that another ball should be dispensed from the meter; and a controller electrically connected to the sensor and responsive to the sensor, the controller also electrically connected to an arm motor to control movement of the arm;

(b) a central storage station for golf balls; and (c) a distribution network connected to the central storage station and connected to the plurality of golf ball dispensers to provide golf balls to the golf ball dispensers.

12. The apparatus of claim 11, wherein:

the distribution network includes a plurality of pipes of a size large enough to convey golf balls to the golf ball dispensers, and having a generally downward slope to urge the balls to distribute to the golf balls dispensers by gravity feed.

13. A method of providing a golf ball to a user comprising the steps of:

storing a plurality of golf balls;

selectively dispensing a single golf ball to a first location; and pivoting an arm independently mounted on a pivot to retrieve the single golf ball from the first location and to place the ball at a predetermined position for a user to hit the golf ball;

sensing that another ball should be dispensed from the meter.

14. The method of claim 13, wherein:

said pivoting step is performed in response to an action taken by the user.

15. The method of claim 13, wherein:

said sensing step is performed by the user activating a sensor; and said pivoting step is performed in response to the user activating the sensor.

16. The method of claim 13, wherein said pivoting step is further defined by the steps of:

receiving the one golf ball in a receiving unit located at a point on the moveable arm;

moving the one golf ball in the receiving unit to a predetermined position; and delivering the one golf ball to the predetermined position.

17. A method of distributing a plurality of golf balls to a plurality of golf ball driving stations comprising the steps of:

receiving a plurality of golf balls in a main storage bin;

feeding the golf balls to a distribution network that includes a plurality of distribution pipes which are connected to the main storage bin and the golf ball dispensers; and delivering a portion of the golf balls to each of the golf ball dispensers via the distribution network; and wherein each golf ball dispenser performs the steps of:

storing a plurality of golf balls;

selectively dispensing a single golf ball to a first location;

pivoting an arm independently mounted on a pivot to retrieve the single golf ball from the first location and to place the ball at a predetermined position for a user to hit the golf ball; and sensing that another ball should be dispensed from the meter.

18. The method of claim 17, wherein:

said pivoting step is performed in response to an action taken by the user.

19. The method of claim 17, wherein:

said sensing step is performed by the user activating a sensor; and said pivoting step is performed in response to the user activating the sensor.

20. The method of claim 17, wherein said pivoting step is further defined by the steps of:

receiving the one golf ball in a receiving unit located at a point on the moveable arm;

moving the one golf ball in the receiving unit to a predetermined position; and delivering the one golf ball to the predetermined position.

* * * * *